US009433842B2

(12) United States Patent
Phillips

(10) Patent No.: US 9,433,842 B2
(45) Date of Patent: Sep. 6, 2016

(54) PRACTIGOAL EXPANDABLE GOAL NET

(71) Applicant: Brian Phillips, Newport Beach, CA (US)

(72) Inventor: Brian Phillips, Newport Beach, CA (US)

( * ) Notice: Subject to any disclaimer, the term of this patent is extended or adjusted under 35 U.S.C. 154(b) by 112 days.

(21) Appl. No.: 14/463,608

(22) Filed: Aug. 19, 2014

(65) Prior Publication Data

US 2015/0057113 A1 Feb. 26, 2015

Related U.S. Application Data

(60) Provisional application No. 61/868,335, filed on Aug. 21, 2013.

(51) Int. Cl.
*A63B 63/00* (2006.01)
*A63B 71/02* (2006.01)

(52) U.S. Cl.
CPC ..... *A63B 63/004* (2013.01); *A63B 2071/026* (2013.01); *A63B 2210/50* (2013.01)

(58) Field of Classification Search
CPC ..... A63B 63/004; A63B 63/00
USPC ..... 473/478, 421; 135/99, 144, 145
See application file for complete search history.

(56) References Cited

U.S. PATENT DOCUMENTS 4,641,676 A * 2/1987 Lynch ..... E04H 15/50 135/115
5,651,551 A * 7/1997 Ferrara ..... A63B 63/004 273/400
5,820,497 A * 10/1998 Pena ..... A63B 63/004 256/70
5,842,939 A * 12/1998 Pui ..... A63B 63/004 273/400
5,954,600 A 9/1999 Gill
6,113,507 A * 9/2000 Padilla ..... A63B 63/004 273/400
6,371,873 B1 * 4/2002 Wang ..... A63B 63/004 273/407
6,402,643 B1 6/2002 Gill
6,629,900 B2 * 10/2003 Wu ..... A63B 63/004 273/407
6,672,980 B1 1/2004 Walsh
7,686,712 B2 * 3/2010 Sifrit ..... A63B 3/004 473/421
7,828,678 B1 * 11/2010 Caruso ..... A63B 63/004 473/416
2004/0036222 A1 * 2/2004 Chou ..... A63B 63/004 273/407
2007/0194534 A1 * 8/2007 Caruso ..... A63B 71/023 273/407
2013/0175422 A1 * 7/2013 Clarke ..... E04H 12/2269 248/523
2015/0057113 A1 * 2/2015 Phillips ..... A63B 63/004 473/478

* cited by examiner

*Primary Examiner* — Gene Kim
*Assistant Examiner* — Mike Chambers
(74) *Attorney, Agent, or Firm* — Kirk A. Buhler; Buhler & Associates

(57) ABSTRACT

Improvements in an expandable goal net are disclosed. The expandable goal net is foldable and can be taken from a full size goal to a smaller size that can be easily compacted for transportation. The vertical legs telescope inside each other to essentially reduce the height of the vertical members to essentially half. The horizontal cross posts fold in half thereby to compact the expandable goal net into a vertical folded rectangle. The folding joints are on the horizontal members. Joints lock into a horizontal orientation and can be released to allow the joints to fold essentially 180 degrees. Corners use similar hinged joints that allow the horizontal members to bend to essentially 90 degrees. Vertical members have locking slides that telescope to reduce the total length of the vertical members. The expandable goal net is made from aluminum tubes and formed or molded plastic components.

19 Claims, 9 Drawing Sheets

PRACTIGOAL EXPANDABLE GOAL NET

CROSS REFERENCE TO RELATED APPLICATIONS

This application is a continuation-in-part of applicant's application Ser. No. 61/868,335 filed Aug. 21, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in an expandable goal net. More particularly, the present expandable net is a goal net that is used for soccer or other sports. The expandable net can be easily transported and erected. The erected net is strong enough for a person to hang from the horizontal member and still be folded and for transportation.

2. Description of Related Art Including Information Disclosed Under 37 CFR 1.97 and 1.98.

There are several games where a ball or other object is kicked or struck into a goal. For many communities or homes a goal is not present and must be supplied by the coach player. There are generally two different types of goal, the first type is a permanent goal that is made from heavy tubular steel where a net is secured or tied into the tubular steel. These heavy tubular steel frames are welded together and can weigh several hundred pounds. The weight of these frames makes transportation, vandalism or stealing these framed fairly difficult. The other type of frames are assembled from pieces or folded and are typically flimsy and fragile where they can be easily damaged. Soccer goals consisting of numerous pieces have the distinct disadvantage that they are difficult and slow to set up. Loose fasteners may require tools for driving or tightening, and may also become lost in transit or storage or during assembly of a goal on a turf playing field.

A number of patents and or publications have been made to address these issues. Exemplary examples of patents and or publication that try to address this/these problem(s) are identified and discussed below.

U.S. Pat. No. 5,954,600 issued Sep. 21, 1999 and U.S. Pat. No. 6,402,643 issued Jun. 11, 2002 both to Sukhinder Gill disclose a Folding Soccer Goal. The folding soccer goal uses elastic cords inside of round or rectangular tubing. The tubed partially telescope inside each other and the elastic cords retain the telescoping tubes together. The telescoping tubes are pulled apart for folding and storage in a bag. While this patent discloses a foldable soccer goal the parts are not do not make a rigid structure that can accept the abuse from athletes handing on the cross members.

U.S. Pat. No. 6,672,980 issued Jan. 6, 2004 to Robert J. Walsh discloses a Sports Goal Collapsible Frame. The goal frame pieces include hinges that allow the components to fold for storage. While the frame folds the connecting hinges will support a child hanging on the goal frame.

U.S. Pat. No. 7,371,195 issued May 13, 2008 to Larry Richard Stevens discloses a Collapsible Sports Goal where the components of the goal use hinges and pivoting components that allow the goal to be quickly folded for storage or expanded for use. While the sports goal can be reduced in size for storage the connecting components can easily be collapsed when not desired.

What is needed is an expandable goal net that has structural components that both fold for easier storage and can be locked in an expanded form while providing similar structural strength to a welded frame. The proposed practigoal expandable goal net provides a solution to this problem.

BRIEF SUMMARY OF THE INVENTION

It is an object of the expandable goal net to be foldable. Because the expandable goal net is foldable the net can be taken from a full size goal to a smaller size that can be easily compacted for transportation. The vertical legs telescope inside each other to essentially reduce the height of the vertical members to essentially half. The horizontal cross post fold in half thereby o compact the expandable goal net into a vertical folded rectangle.

It is an object of the expandable goal net to have folding joints. The folding joints are on the horizontal members. The joints lock into a horizontal orientation and can be released to allow the joints to fold essentially 180 degrees. The corners use similar hinged joints that allow the horizontal members to bend to essentially 90 degrees. The vertical members have locking slides that telescope to reduce the total length of the vertical members.

It is another object of the expandable goal net to have essentially the same strength as a welded goal frame. In many cases a goal frame receives high impacts from a ball making contact, an athlete running into the goal frame or a person hanging onto the center span of the horizontal members. Without proper structural locking joints an expandable goal net frame could be easily damaged whereby making an expensive foldable goal net a worthless bent frame.

It is still another object of the expandable goal net to be made from light-weight material. The expandable goal net is made from aluminum tubes and formed or molded plastic components. The light-weight materials make the expandable goal net easy to transport or roll from a vehicle to a grass field where the expandable goal net can be expanded and erected for use by players. The transportation can be from integrated wheels or from a hand truck.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 1 shows a front view of the expandable goal net.
FIG. 2 shows a top view of the expanded goal net.
FIG. 3 shows a side view of the expanded goal net.

DETAILED DESCRIPTION OF THE INVENTION

Figure 1:
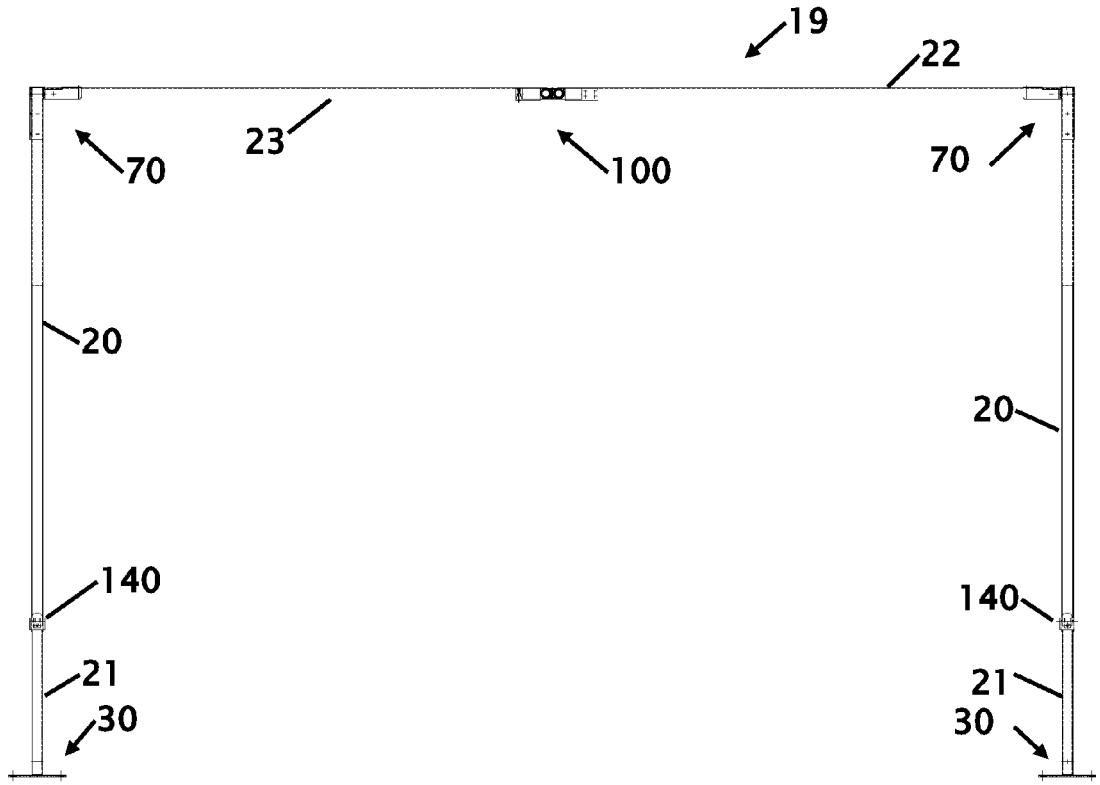
Figure 2:
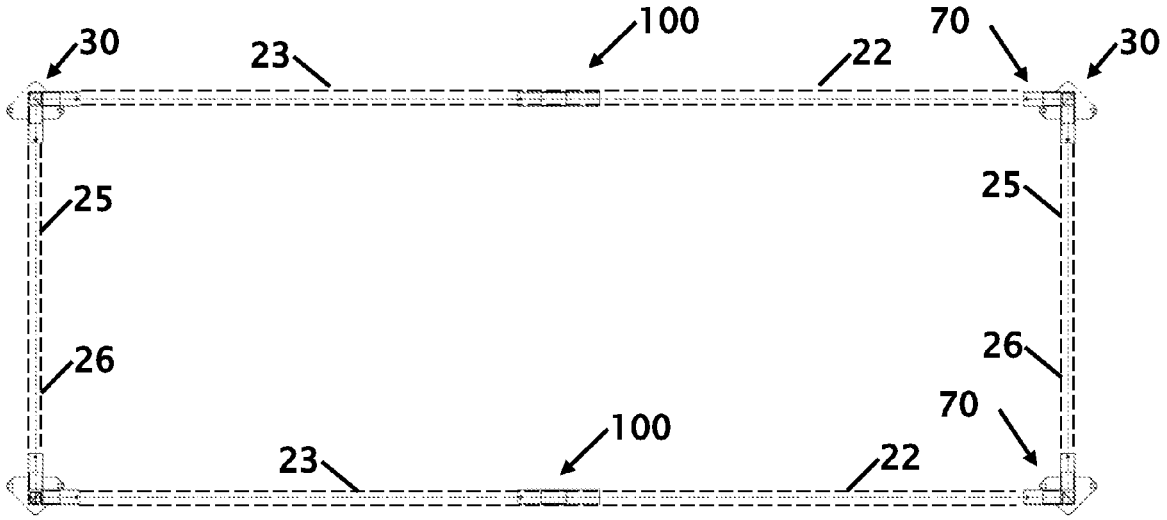
Figure 3:
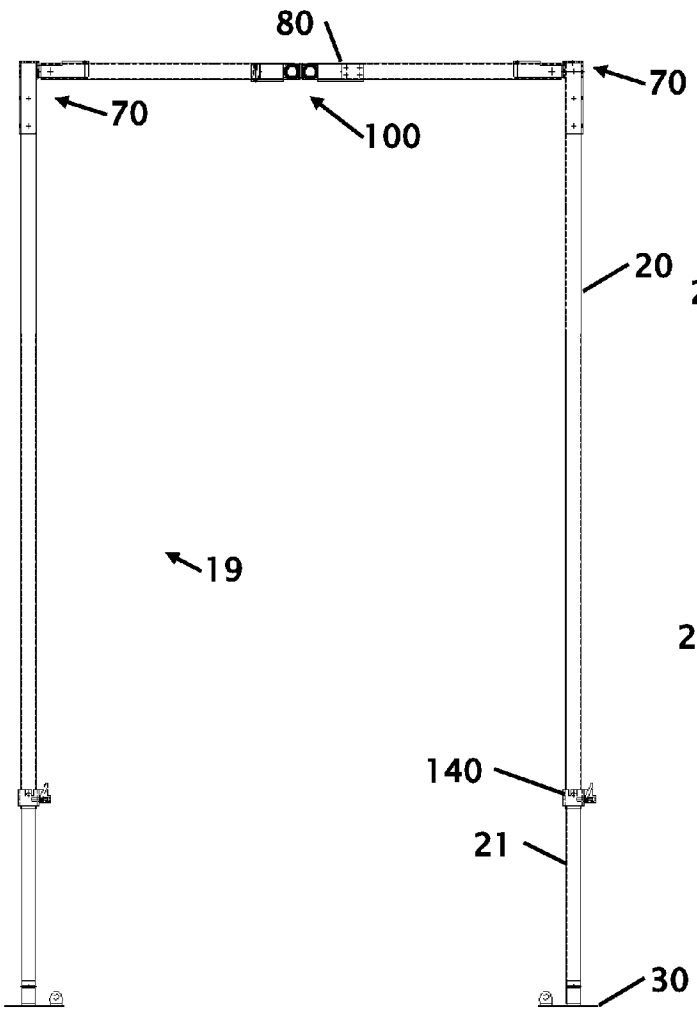

FIG. 1 shows a front view of the expandable goal net 19 and FIG. 2 shows a top view of the expanded goal net 19 and FIG. 3 shows a side view of the expanded goal net 19. The expanded goal net 19 is constructed from multiple square or rectangular tube members made preferably of aluminum. While aluminum is the preferred material for the tubing members, the tubes can be made from steel or other materials at the expense of weight. The tubing members are connected together with joints or other connecting members. The joints and connecting members are preferably made from molded plastic components that fit within the tubing members. The frame of the expanded goal net 19 can be reduced in size by folding or compressing and then expanded and covered with a net. With this understanding of the basic components we now refer to the figures showing how these various components connect together.

From FIGS. 1, 2 and 3 the expanded goal net 19 has four vertical legs made from an outer tube 20 and an inner tube 21. The inner tube 21 telescopes with the outer leg 22. The inner tube 21 is retained in position in the outer tube 22 with a locking pin 140 that retains the two tube members in an extended position (for use) or in a retracted position (for storage). An enlarged foot 30 is secured to the end of the inner tubes 21. The enlarged feet 21 spread the load of the expanded goal net 19 and provide a more stable footing for the expanded goal net 19. At the top ends of the outer tubes 20 are connected with straight hinge arms 80, 90, knuckles 100 and corner brackets 70. The top portion of the frame includes horizontal tubes 22, 23 and side tubes 25, 26. The horizontal tubes 22*m* 23 and the side tubes 25, 26 hinge or fold at a mid-span to reduce the length of these members as shown in FIGS. 4 and 5.

Figure 5:
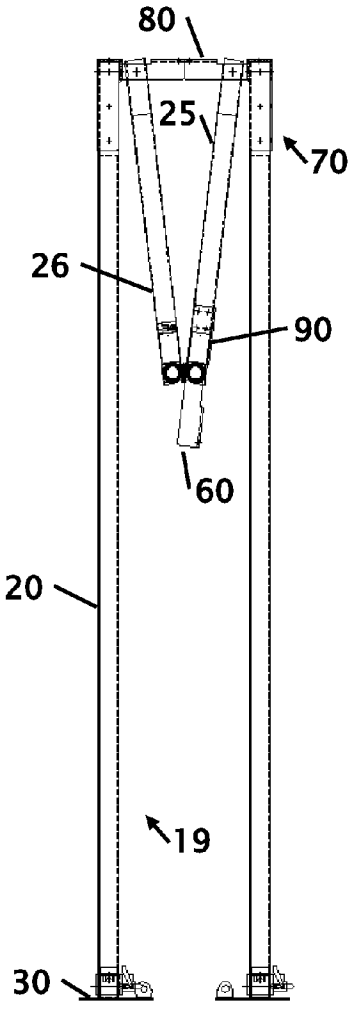
FIG. 5 shows a side view of a folded goal net.
Figure 4:
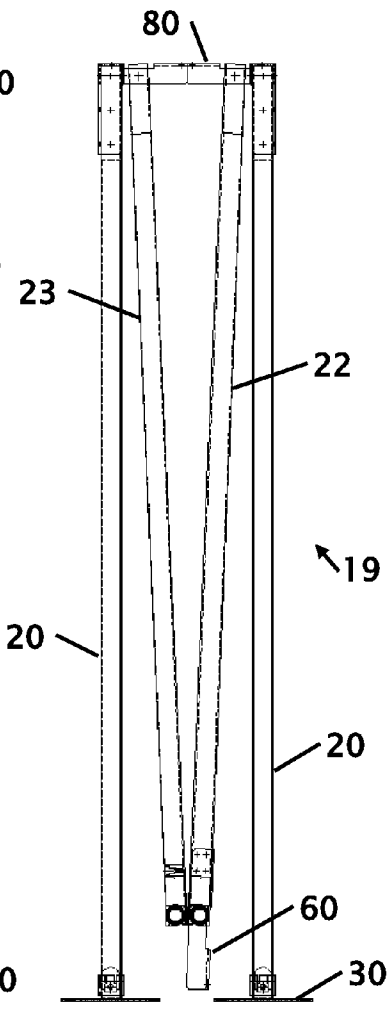
FIG. 4 shows a front view of a folded goal net.

FIG. 4 shows a front view of a folded goal net and FIG. 5 shows a side view of a folded goal net 19. In both of these figures the vertical legs are shown in a reduced height with the inner tube 21 retracted within the outer tube 20. From FIG. 4 the two horizontal tubes 22 and 23 are shown bent with the straight bracket 60 shown free from horizontal tube 23. From FIG. 5 the two side tubes 25 and 26 are shown bent with the straight bracket 60 shown free from horizontal tube 26. In the top of both of these views, the first hinge arms 80 are shown engaged in the corner brackets 70 and in contact together between the vertical legs. The joints pivot on knuckles. At the bottom of these figures the footer 30 is shown where the expandable goal net 19 can stand in and expanded or retracted orientation on the ground.

Figure 6A:
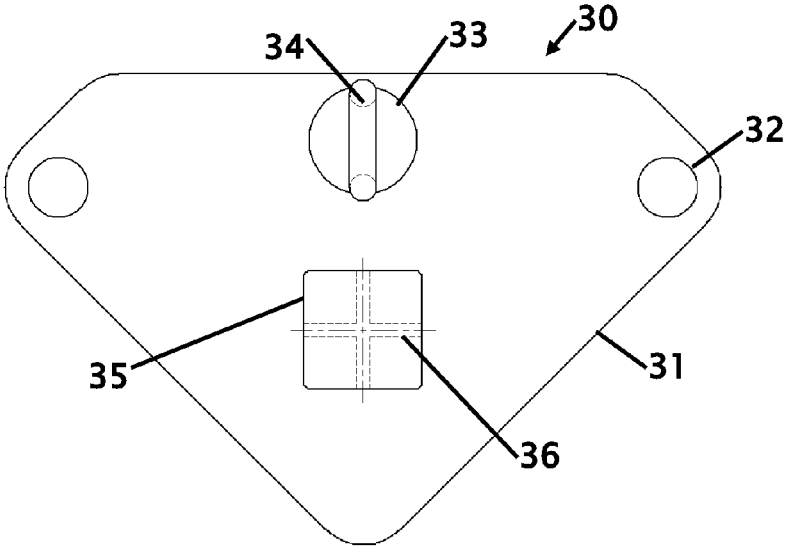
FIG. 6A to 6C show views of the footer.
Figure 6C:
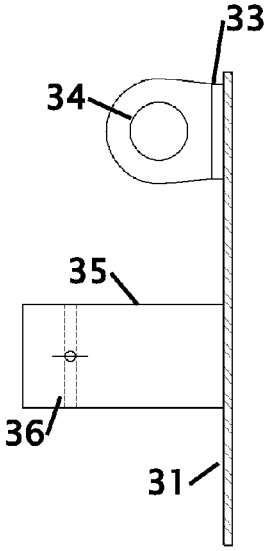
Figure 6B:
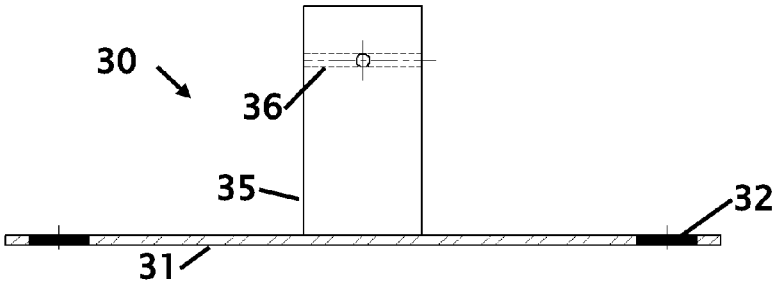

FIG. 6A to 6C show views of the footer 30. The footer 30 is an essentially triangular base 31. The triangular base 31 allows the four other feet to nest in closer proximity to each other. The footer 30 is preferably fabricated from plastic in an injection molding operation, but other material and fabrication materials and methods are contemplated and will pride a product with essentially the same function and support. Near the center of the triangular base a square or rectangular post 35 extends perpendicular to the base 31. The square or rectangular post 35 is shaped and configured to fit within the inner tube 21 shown previously in the assembled expandable goal net 31. One or more cross holes 36 extend through the square or rectangular post to secure the inner tube 21 onto the post 35. A plurality of holes 32 extend through the triangular base to allow a stake to be driven through the triangular base 31 and holes 32 to secure the footer to the ground. A stand-off 33 supports a ring connection 34. The ring connection 34 allows for securing a net to the footer with a string, rope, zip tie, bungee cord or other securing mechanism or means.

Figure 7B:
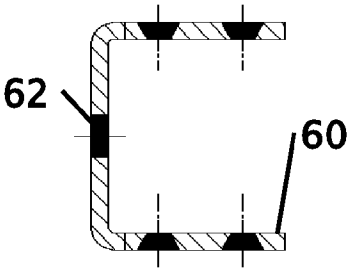
FIG. 7A to 7C show views of the straight bracket.
Figure 7A:
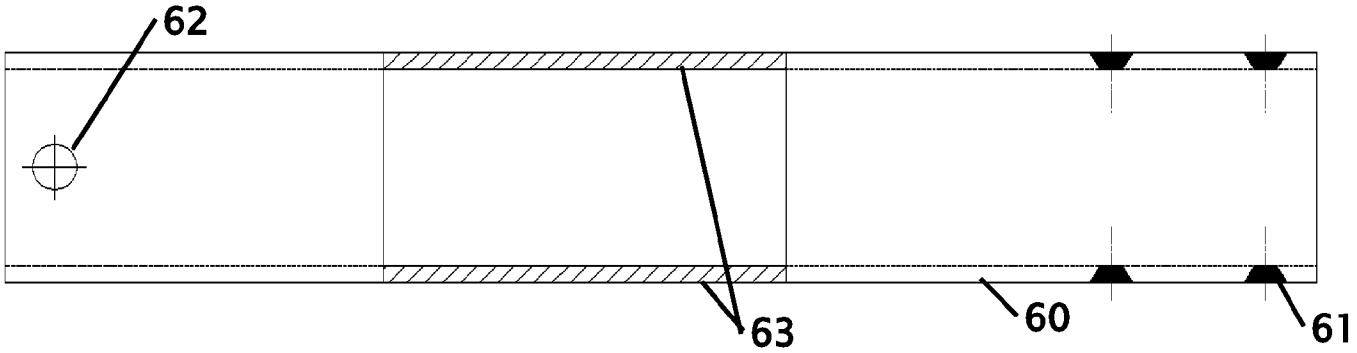
Figure 7C:
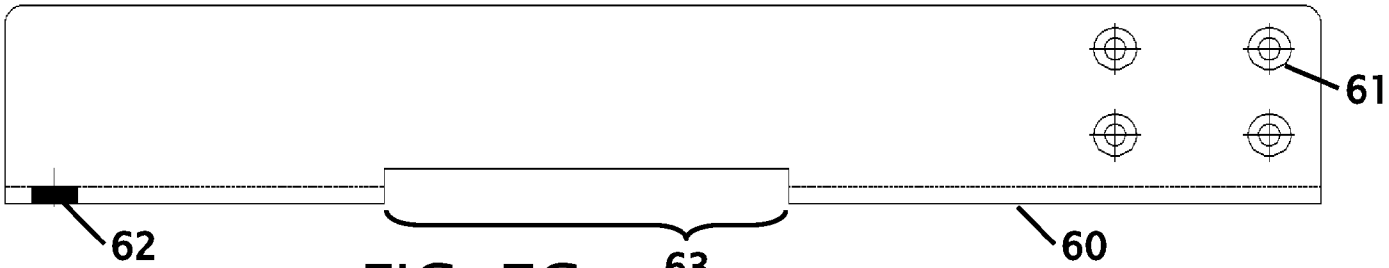

FIG. 7A to 7C show views of the straight bracket 60. The straight bracket 60 partially slides into tubular members where the straight bracket 60 is secured to the tubular members with fasteners that pass through holes 61 and the tubular members. A hole 62 provides a connection for locking or securing the straight bracket 60 into a complimentary horizontal or side tube. A recess 63 provides clearance for hinge arms shown and described in FIGS. 9 and 10.

Figure 8B:
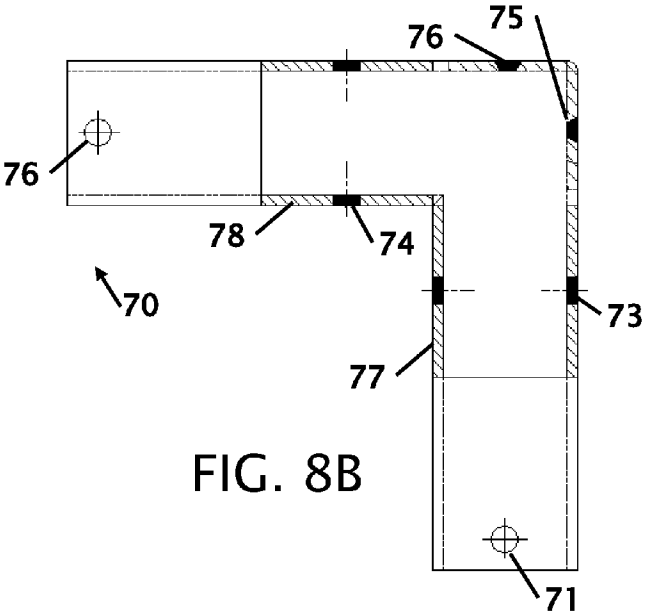
FIG. 8A to 8C show views of the corner bracket.
Figure 8A:
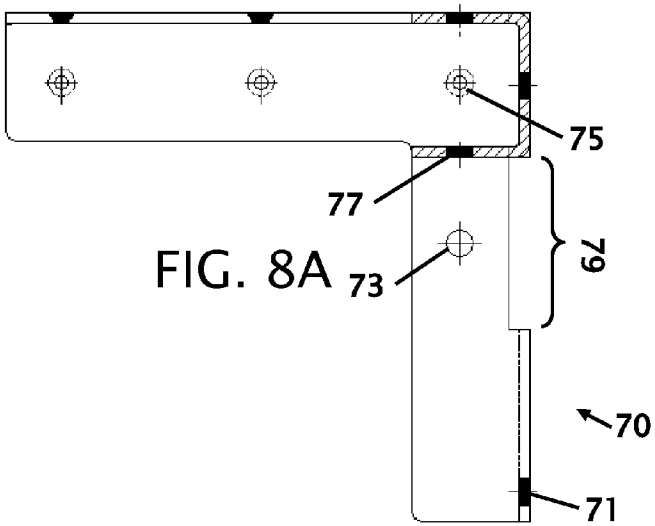
Figure 8C:
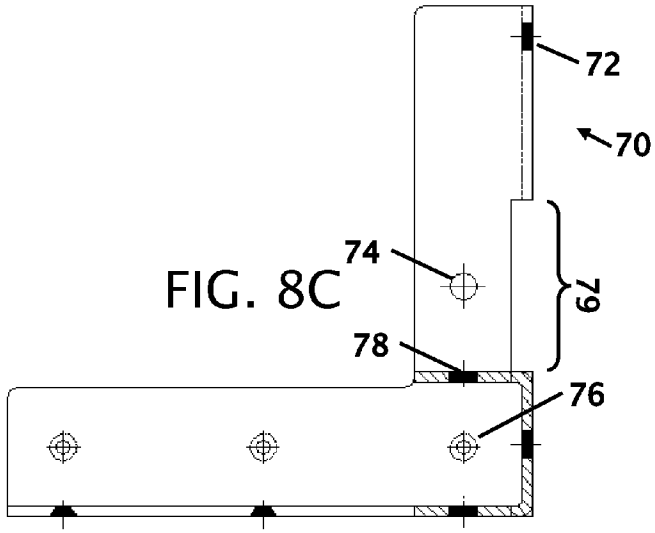

FIG. 8A to 8C show views of the corner bracket 70. The corner bracket 70 joins the tubes that intersect orthogonally. A plurality of holes 71 to 78 allow for securing outer tubes 20, horizontal tubes 22, 23 and side tubes 25, 26 to the corner bracket 70. Clearance notches 79 provide clearance for hinge arms, shown and described in FIGS. 9 and 10 and or knuckles 100, shown in FIG. 11.

Figure 9A:
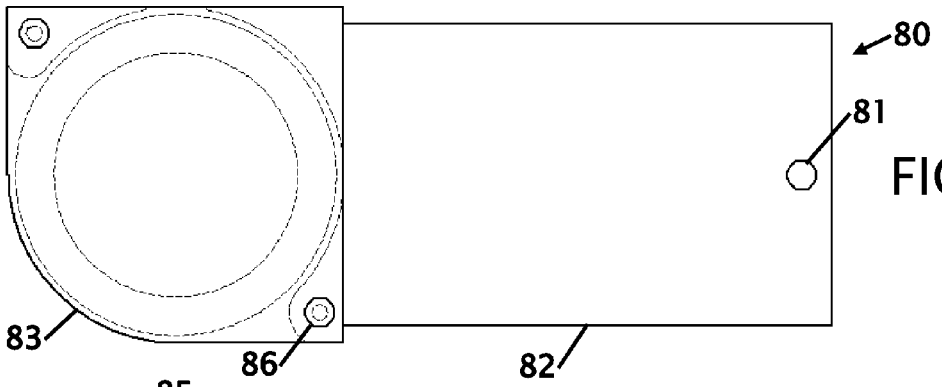
FIGS. 9A and 9B show views of a first hinge arm.
Figure 9B:
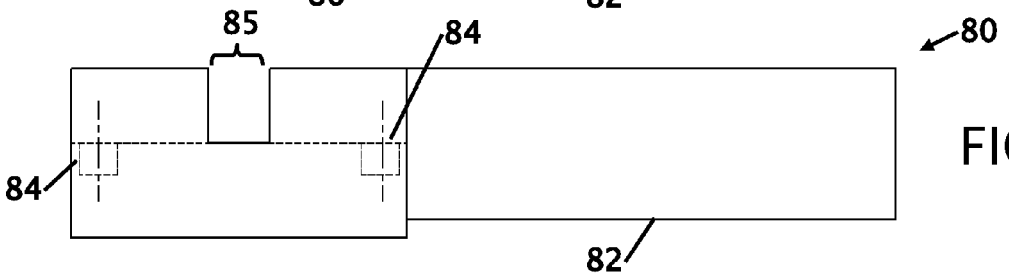
Figure 10A:
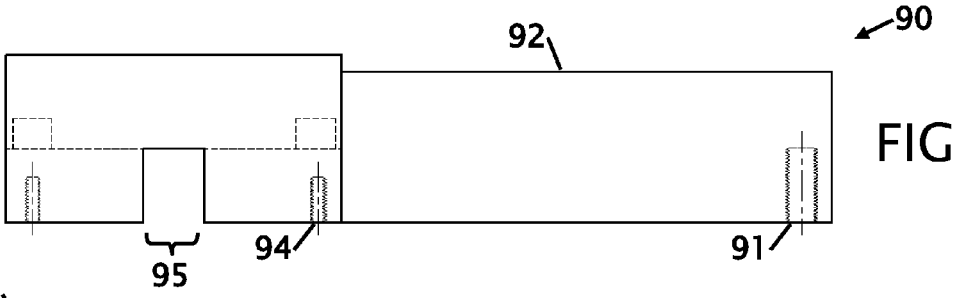
FIGS. 10A and 10B show views of a second hinge arm.
Figure 10B:
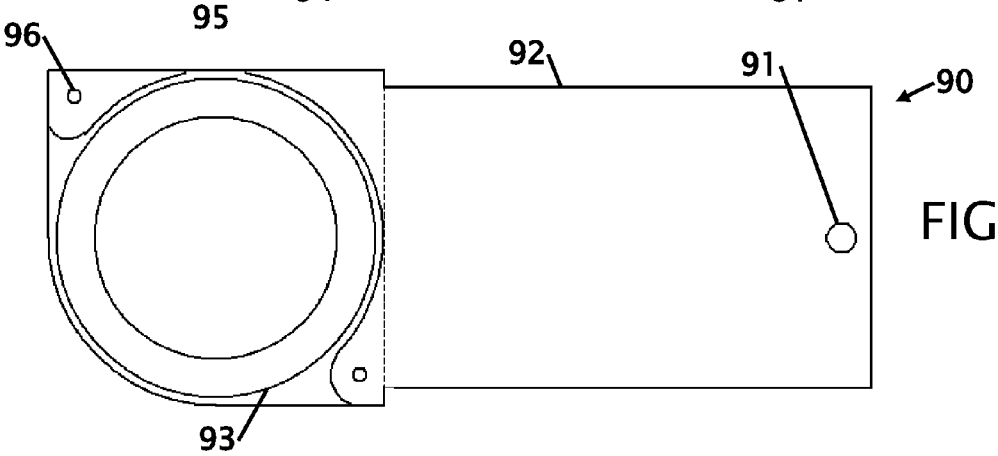

FIGS. 9A and 9B show views of a first hinge arm 80 and FIGS. 10A and 10B show views of a second hinge arm 90. These hinge arms 80 and 90 have extensions 82 and 92 that fit within outer tubes 20, horizontal tubes 22, 23 and side tubes 25, 26. A hole 81, 91 allows a fastener to pass through the outer tubes 20, horizontal tubes 22, 23 and side tubes 25, 26, and secure into the hole 81 or 91. The head of the hinge arms 80 and 90 have a circular bearing surface 83 and 93 that guide the knuckle 100. Recess 84 in the first hinge arm provides clearance for the head of a fastener to screw into hole 94 in the second hinge arm 90. Recess 86 in the first hinge arm provides clearance for the head of a fastener to screw into hole 96 in the second hinge arm 90.

Figure 12:
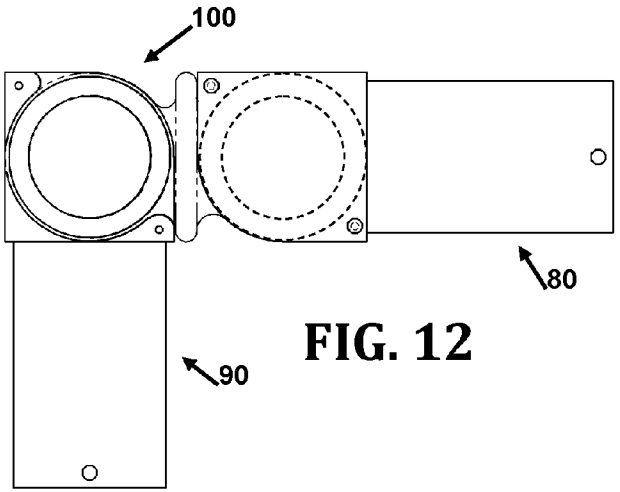
FIG. 12 shows an assembled view of the arms and a knuckle.
Figure 11C:
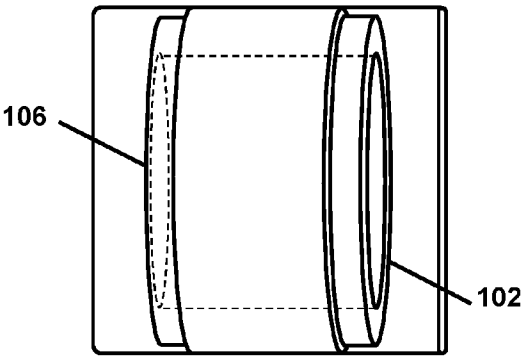
FIG. 11A to 11C show views of the knuckle.
Figure 11A:
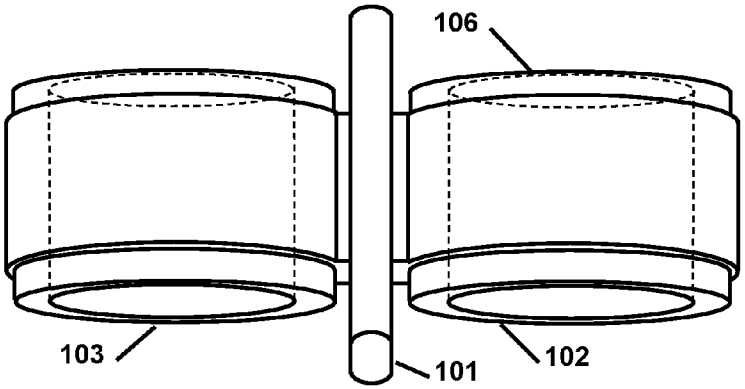
Figure 11B:
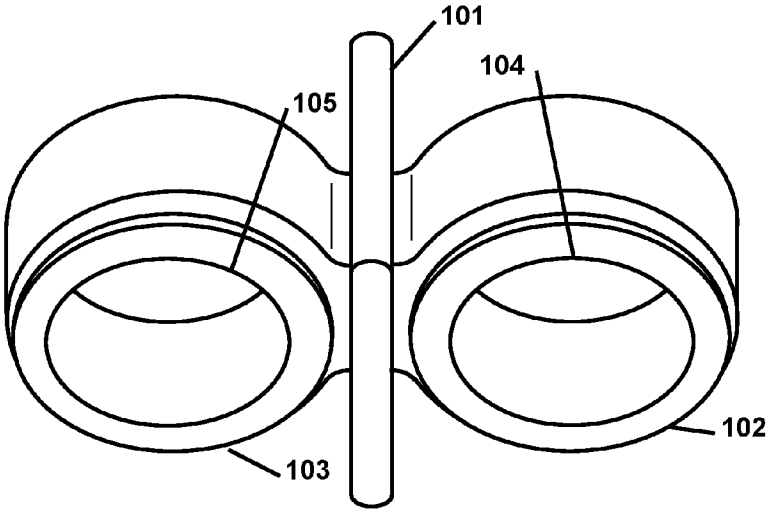

FIG. 11A to 11C show views of the knuckle 100 and FIG. 12 shows an assembled view of the arms 80 and 90 with a knuckle 100. The knuckle 100 is essentially a double sided coupling that connects between arms 80, 90, straight brackets 60 and corner brackets 70. The knuckle 100 has a divider 101 where the two sides are symmetric from the divider 101. On each side of the divider 101 two circular outer 102, 103 and inner 104, 105 bearing surfaces exist. These bearing surfaces allow the connecting members to articulate to provide folding of the frame of the expandable goal net 19. In addition to the circular bearing surfaces, side surfaces 102 and 106 provide additional bearing surfaces. The material of the knuckle 100 is selected to allow for smooth rotational movement and also structural strength of the erected expandable goal net 19.

Figure 13A:
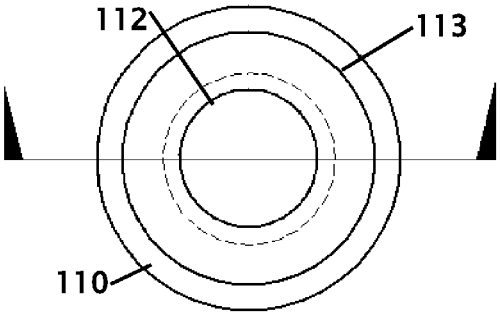
FIGS. 13A and 13B show views of a tube standoff.
Figure 13B:
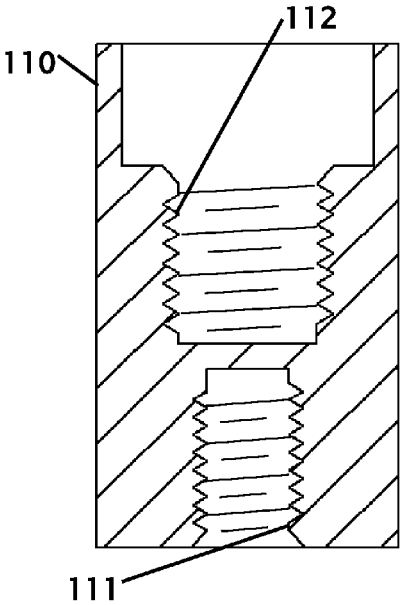

FIGS. 13A and 13B show views of a tube standoff 110. The standoff 110 is essentially a cylindrical shape with a first side having a recess 113 clearance that terminates with a threaded connection 112. The opposite side of the standoff 100 has a threaded hole 111.

Figures 14A, 14B:
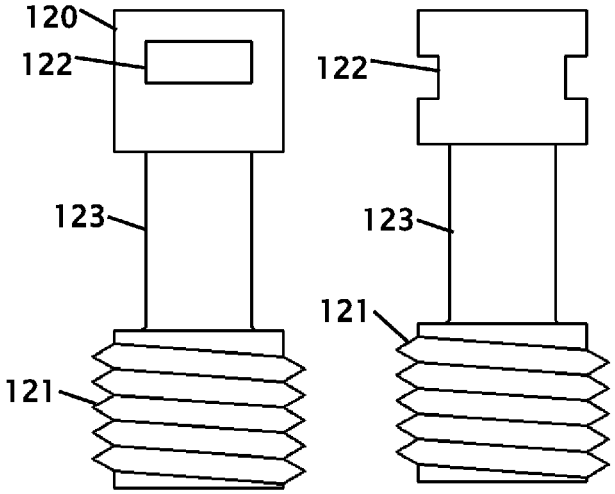
FIGS. 14A and 14B show views of a lock screw.

FIGS. 14A and 14B show views of a lock screw 120. The lock screw 120 has a central shank 123. At one side of the central shank 123 a threads 121 exist that can be screwed into the tube standoff 110. At the opposing side of the central shank 123 is a cylindrical head 120 with a recess 122 cut across the cylindrical head 120.

Figure 15A:
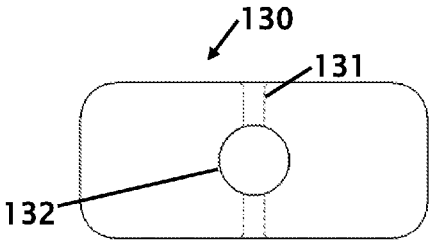
FIG. 15A to 15C show views of the lock knob.
Figure 15C:
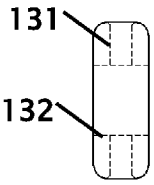
Figure 15B:
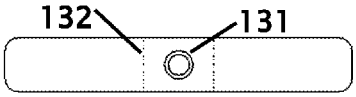

FIG. 15A to 15C show views of the lock knob 130. The lock knob 130 is essentially a flat rectangle with central hole 132 that passes through the lock knob 130. A hole 131 passes perpendicular to the central hole 132 and the lock knob 130.

Figure 16:
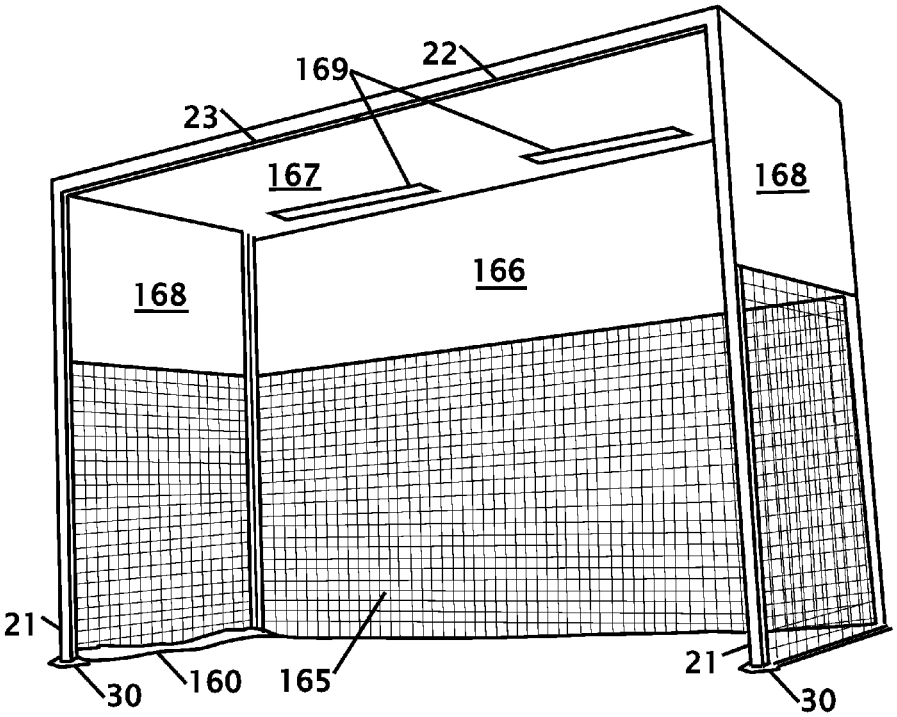
FIG. 16 shows a perspective view of the practice goal with a net and canopy.

FIG. 16 shows a perspective view of the practice goal with a net and canopy. In this figure the frame is covered with a canopy having an upper portions with sides 168, and back 166 and a top 167. The sides 168, back 166 and top and essentially opaque and provide protection from the sun and also from rain. It provides a shelter from the elements for the team, coach and or goal tender before, after or during play. The top surface 167 has a plurality of openings 169 for venting of air and wind to keep the interior of the goal cooler and prevent wind from lifting the goal and canopy. While two openings 169 are shown, this could include as few as one opening to more than two. It is also contemplated that the top surface 167 could be configured with flaps to allow for air movement. The lower portion of the canopy has a net structure 165.

The net structure allows for air movement through the goal and allows for capturing of balls that enter the goal. On the bottom of the net structure 165 a pocket 160 is joined to the net. The pocket 160 has a stretchable cord that maintains the net in proximity to the ground. The pocket 160 and stretchable cord is secured to the base feet 30 that are connected to the vertical support members 21. The canopy extends along the vertical members 21 and over the horizontal tubular members 22 and 23 of the goal. The canopy is remains on the frame whereby the frame and the canopy is erected and collapsed with the expandable goal as a single unit.

Figure 17:
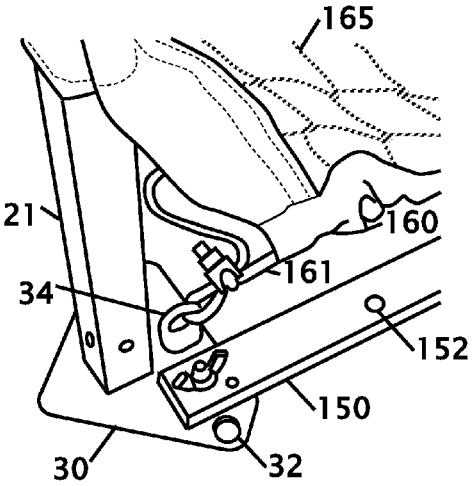
FIG. 17 is a perspective view of a front foot pad from FIG. 16.

FIG. 17 is a perspective view of a front foot pad 30 from FIG. 16. This figure shows a front foot pad 30. The front foot pad 30 has the vertical support tube 21 attached to the foot pad 30. The foot pad 30 further has an eyelet 34 with an opening for securing the stretchable cord 161. The stretchable cord 161 runs through a pocket or canal 160 in a bottom section of the net 165. A weighted bar 150 is removably secured to the foot pad 30. The weighted bar 150 provides weight to keep the goal more secure to the ground and also provides dimensional stability between each front vertical pole 21 and the rear pole. The foot pad 30 and the weighted bar 150 have holes 32 and 152 respectively for a stake to be driven through the hole to further secure the goal to a location on the ground to prevent movement caused by wind or the goal being struck by a person or a ball.

Figure 18:
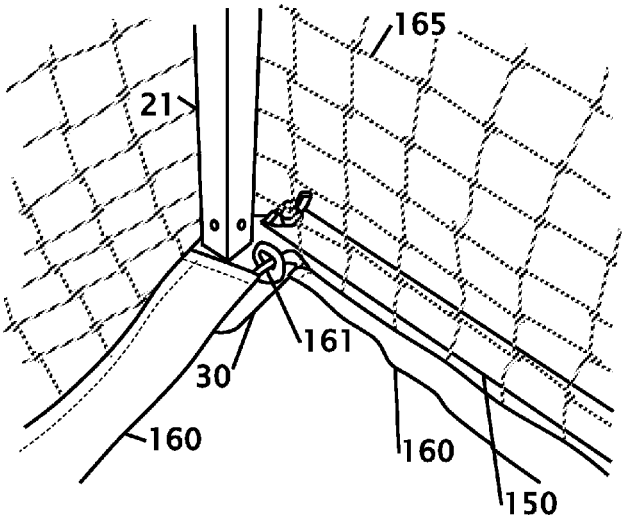
FIG. 18 is a perspective view of a rear foot pad from FIG. 16.

FIG. 18 is a perspective view of a rear foot pad from FIG. 16. The rear foot pad 30 shows an eyelet with the stretchable cord 161 passing from one pocket or channel 160 through the eyelet and into another channel or pocket 160 to keep the bottom of the net in proximity to the ground. The weighted bar 150 is shown along the right side of this figure and removably secured to the foot pad 30. The net 165 is shown stretching around the vertical pole 21.

Thus, specific embodiments of an expandable goal net have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An expandable goal net comprising:

a frame;

said frame having four extendable vertical members wherein each extendable vertical member includes a foot pad;

said foot pad includes a ring connection;

said frame supporting a net;

said net including at least one pocket extending along a lower edge of said net;

said frame having two folding horizontal members;

said frame having two folding side members, and said net is secured to said frame and is deployable at least partially over said frame wherein said net further includes an opaque canopy and said opaque canopy further includes a net section.

2. The expandable goal net according to claim 1 wherein said folding horizontal side members have a first hinge arm and a second hinge arm.

3. The expandable goal net according to claim 2 wherein said first hinge arm and said second hinge arm connect through a knuckle.

4. The expandable goal net according to claim 3 said knuckle has a first circular guide and a second circular guide.

5. The expandable goal net according to claim 4 wherein said first circular guide connects to said first hinge arm and said second circular guide connects with said second hinge arm.

6. The expandable goal net according to claim 5 wherein said knuckle allows said first hinge arm and said second hinge arm to fold essentially parallel to each other.

7. The expandable goal net according to claim 1 wherein said four extendable vertical members connect to one of said two folding horizontal members and one of said two folding side members with an L bracket wherein said L bracket has perpendicular support extending perpendicular to said L bracket.

8. The expandable goal net according to claim 7 said four extendable vertical members connect to one of said two folding horizontal members and one of said two folding side members, each with a knuckle.

9. The expandable goal net according to claim 7 wherein said knuckle allows said folding horizontal member to fold essentially parallel to said perpendicular support.

10. The expandable goal net according to claim 9 wherein said knuckle allows said folding side member to fold essentially parallel to said perpendicular support.

11. The expandable goal net according to claim 7 wherein said one of said two folding horizontal members and one of said two folding side members fold parallel with said perpendicular extending support.

12. The expandable goal net according to claim 1 wherein said foot pad further includes at least one hole.

13. The expandable goal net according to claim 12 further includes at least one stake that fits through said at least one hole.

14. The expandable goal net according to claim 1 wherein said at least one pocket includes a stretchable cord that extends from a first front extendable vertical member to first rear extendable vertical member to a second rear extendable vertical member to a second front extendable vertical member.

15. The expandable goal net according to claim 1 wherein said foot pad is triangular.

16. The expandable goal net according to claim 1 further includes at least one removable weighted bar.

17. The expandable goal net according to claim 1 wherein said four extendable vertical members extend by telescoping members.

18. The expandable goal net according to claim 1 wherein said vertical members, horizontal members and said side members are coupled with a corner bracket.

19. The expandable goal net according to claim 1 wherein said each of said four extendable members extend with telescoping sections.

* * * * *